US008672657B2

(12) United States Patent
Masuda et al.

(10) Patent No.: US 8,672,657 B2
(45) Date of Patent: Mar. 18, 2014

(54) DOUBLE GEAR PUMP WITH IMPROVED BEARINGS

(75) Inventors: Seiei Masuda, Tokyo (JP); Yasushi Matsunaga, Hanno (JP)

(73) Assignee: IHI Corporation (JP)

( * ) Notice: Subject to any disclaimer, the term of this patent is extended or adjusted under 35 U.S.C. 154(b) by 1059 days.

(21) Appl. No.: 12/438,445

(22) PCT Filed: Aug. 15, 2007

(86) PCT No.: PCT/JP2007/065905
§ 371 (c)(1),
(2), (4) Date: Feb. 23, 2009

(87) PCT Pub. No.: WO2008/023619
PCT Pub. Date: Feb. 28, 2008

(65) Prior Publication Data

US 2010/0247365 A1 Sep. 30, 2010

(30) Foreign Application Priority Data

Aug. 23, 2006 (JP) ..... 2006-226931

(51) Int. Cl.
*F01C 1/24* (2006.01)
*F04C 2/24* (2006.01)

(52) U.S. Cl.
USPC ..... 418/196; 418/206.7

(58) Field of Classification Search
USPC ..... 418/196, 206.7
See application file for complete search history.

(56) References Cited

U.S. PATENT DOCUMENTS

| | | | | |
|---|---|---|---|---|
| 2,960,039 A * | 11/1960 | Ovretveit | ..... | 418/196 |
| 4,605,363 A | 8/1986 | Walsh | ..... | 418/131 |
| 7,591,640 B2 * | 9/2009 | Masuda et al. | ..... | 418/196 |

FOREIGN PATENT DOCUMENTS

| | | | | |
|---|---|---|---|---|
| EP | 0 661 455 A1 | 7/1995 | | |
| JP | UM-B-54-002405 | 2/1979 | | |
| JP | A-61-223280 | 10/1986 | | |
| JP | A-63-85276 | 4/1988 | | |
| JP | 2003-328958 | 11/2003 | | |
| JP | 2004-197573 A | 7/2004 | | |
| JP | 2005-042627 A | 2/2005 | | |
| JP | 2005042627 A * | 2/2005 | ..... | F04C 15/00 |

OTHER PUBLICATIONS

International Search Report dated Sep. 11, 2007, issued in corresponding international application No. PCT/JP2007/065905.
Japanese Office Action dated Nov. 1, 2011 issued in corresponding Japanese Patent Application No. 2006-226931 with English translation (6 pages).
Search Report dated Oct. 15, 2012 issued in corresponding European Patent Application No. 07792539.4 (5 pages).

* cited by examiner

*Primary Examiner* — Mary A Davis
(74) *Attorney, Agent, or Firm* — Ostrolenk Faber LLP

(57) ABSTRACT

In a double gear pump that is provided with a drive gear; two driven gears that are oppositely arranged with the drive gear therebetween, a first bearing that supports a drive shaft of the drive gear; and a second and a third bearings that support rotating shafts of the two driven gears, the bearing length of the first bearing is formed shorter than the bearing lengths of the second and third bearings. According to the present invention, it is possible to provide a double gear pump that is capable of easily and reliably reducing the bearing loss of a bearing that support a gear.

4 Claims, 5 Drawing Sheets

DOUBLE GEAR PUMP WITH IMPROVED BEARINGS

CROSS REFERENCE TO RELATED APPLICATIONS

The present application is a 35 U.S.C. §371 National Phase conversion of PCT/JP2007/065905, filed Aug. 15, 2007, which claims benefit of Japanese Application No. 2006-226931, filed Aug. 15, 2006. The PCT International Application was published in the Japanese language.

TECHNICAL FIELD

The present invention relates to a double gear pump.

BACKGROUND ART

The fuel supply system of a jet engine (turbofan engine) that is used for an airplane and the like generally has a constitution that boosts pressure of fuel from the fuel tank by means of a fuel pump that is a booster portion, determines the flow rate by means of a fuel metering mechanism, sends that fuel to the engine combustor in the jet engine, and returns the surplus fuel to an inlet of the fuel pump.

A gear pump has conventionally been used as the fuel pump. Rotational movement that is transmitted from the engine drives the gear pump via gears in an accessory gear box serving as an engine auxiliary device. For this reason, the amount of discharge of the gear pump is approximately proportional to the rotational frequency of the engine.

With such a gear pump, it is possible to boost the fuel pressure by confining the fuel to a closed space that is formed by the gears and the inner wall surface of the casing.

In recent years, a double gear pump as disclosed for example in Patent Document 1 has been employed. A double gear pump is equipped with two driven gears that are oppositely arranged with the drive gear therebetween, and so boosts the fuel pressure by confining the fuel to a closed space that is formed by the two driven gears and the casing. For this reason, it is possible to obtain a sufficient discharge amount even in the state of low-speed rotation of the drive gear.

[Patent Document 1] Japanese Unexamined Patent Application, first publication No. 2003-328958

DISCLOSURE OF THE INVENTION

Problem to be Solved by the Invention

Incidentally, the drive gear and the two driven gears of a double gear pump are respectively supported by journal bearings. The journal bearings support the drive shaft of the drive gear and the rotating shafts of the two driven gears by sliding contact via an oil film.

In the sliding contact, oil film temperature, friction characteristics and the like readily become problematic. In the journal bearings, the longer the bearing length, the more pronounced these problems become, and moreover the problem arises of the bearing loss becoming larger.

The present invention was achieved in view of the above circumstances, and has as its object to provide a double gear pump capable of easily and reliably reducing the bearing loss of a bearing that supports a gear.

Means for Solving the Problem

The double gear pump according to the present invention adopts the following apparatus in order to solve the above-mentioned problems.

A double gear pump that is provided with a drive gear; two driven gears that are oppositely arranged with the drive gear therebetween, a first bearing that supports a drive shaft of the drive gear; and a second and a third bearings that support rotating shafts of the two driven gears, in which the bearing length of the first bearing is formed shorter than the bearing lengths of the second and third bearings.

Also, the first bearing consists of a pair of bearing portions that are oppositely arranged with the drive gear therebetween, and at least one bearing length is formed short.

Also, the first bearing is disposed in close contact with the side surface of the drive gear.

Also, a positioning member is provided that brings the first bearing into close contact with the side surface of the drive gear.

Also, the first bearing is integrally formed with the positioning member.

Effect of the Invention

According to the present invention, it is possible to obtain the following effects.

Since the bearing length of the first bearing that supports the drive shaft of the drive gear is formed shorter than the bearing lengths of the second and third bearings that support the rotating shafts of the two driven gears, it is possible to easily and reliably reduce the bearing loss of the first bearing.

Also, by disposing the first bearing in close contact with the side surface of the drive gear, it is possible to prevent leakage of the transported object between the drive gear and the driven gears.

Also, by providing a positioning member that brings the first bearing into close contact with the side surface of the drive gear, even if the bearing length of the first bearing is formed short, it is possible to reliably bring it into close contact with the side surface of the drive gear.

Also, since the first bearing is integrally formed with the positioning member, it is possible to avoid/suppress an increase in the number of components, a worsening of assemblability, cost increases and the like.

BRIEF DESCRIPTION OF THE REFERENCE NUMERALS

S fuel supply system; 1 fuel tank; 2 fuel pump (double gear pump) 20 drive gear; 21 first driven gear; 22 second driven gear; 36 first bearing; 37 second bearing; 38 third bearing;

36*a*, 36*b*, 37*a*, 37*b*, 38*a*, 38*b* bearing portions; 40*a*, 40*b* collars (positioning members); L0, L1 bearing lengths

BEST MODE FOR CARRYING OUT THE INVENTION

Hereinbelow, an embodiment of the double gear pump according to the present invention shall be described with reference to the appended drawings.

Figure 1:
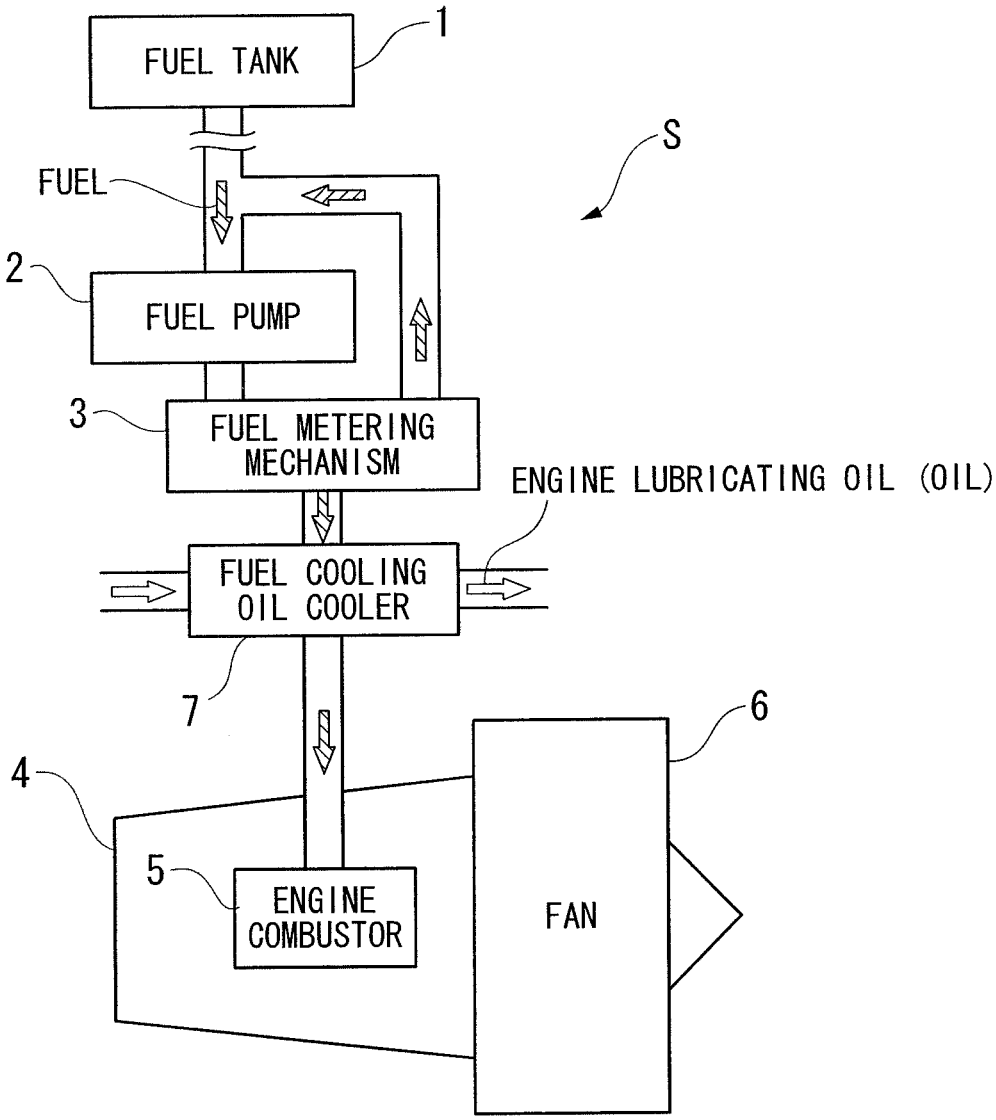
FIG. 1 is a system diagram of a fuel supply system S that has a fuel pump 2 according to one embodiment of the present invention.

FIG. 1 is a system diagram of a fuel supply system S that has a fuel pump 2 according to the present embodiment.

The fuel supply system S equipped with the fuel pump 2 is equipped with a fuel tank 1 and a fuel metering mechanism 3 in addition to the fuel pump 2, and is connected to a jet engine 4. Also, the jet engine 4 is equipped with an engine combustor 5 and a fan 6, and a fuel cooling oil cooler 7 is arranged between this jet engine 4 and the fuel supply system S.

The fuel tank 1 is a tank that stores the fuel to be supplied to the jet engine 4, with the fuel pump 2 being arranged at the post-stage of this fuel tank 1. The fuel metering mechanism 3 is arranged at the post-stage of the fuel pump 2. This fuel metering mechanism 3 determines the flow rate of fuel by the transmission of information such as the position of the throttle lever that is provided in the airplane, and based on this determined flow rate supplies a portion of the fuel that has been discharged from the fuel pump 2 to the jet engine while returning the surplus to an inlet of the fuel pump 2.

The fuel metering mechanism 3 is arranged at the post-stage of the above-mentioned fuel pump 2, and supplies a predetermined amount of the fuel that has been boosted by the fuel pump 2 to the jet engine 4. Information such as the position of the throttle lever is transmitted, and this fuel metering mechanism 3 determines the amount of fuel to be supplied to the jet engine 4 in accordance with this information.

Note that as illustrated, the fuel metering mechanism 3 supplies the surplus fuel that was not supplied to the jet engine 4 to the fuel pump 2 again through a surplus line.

The fuel cooling oil cooler 7 is a heat exchanger which carries out heat exchange between the fuel and the engine lubricating oil (oil), and is arranged between the fuel metering mechanism 3 and the jet engine 4.

The jet engine 4, which is equipped with the engine combustor 5 and the fan 6 as mentioned above, causes combustion of the fuel that is supplied via the fuel cooling oil cooler 7 in the engine combustor 5, and obtains rotation power by driving the fan 6 using the energy obtained by this combustion.

Next, the constitution of the fuel pump 2 according to the present embodiment shall be described with reference to FIG. 2.

Figure 2:
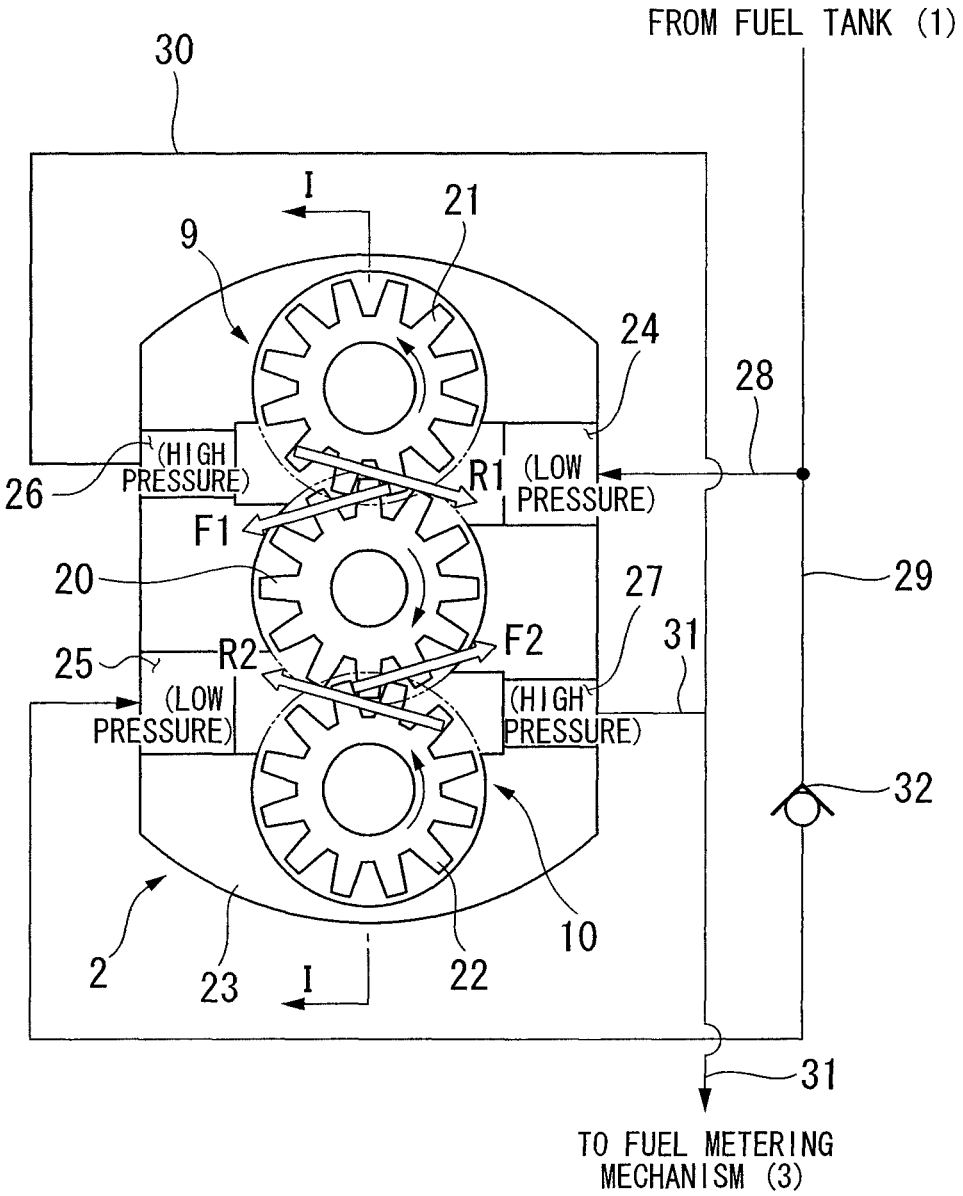
FIG. 2 is an outline block diagram of the fuel pump 2 (double gear pump) according to one embodiment of the present invention.
Figure 3:
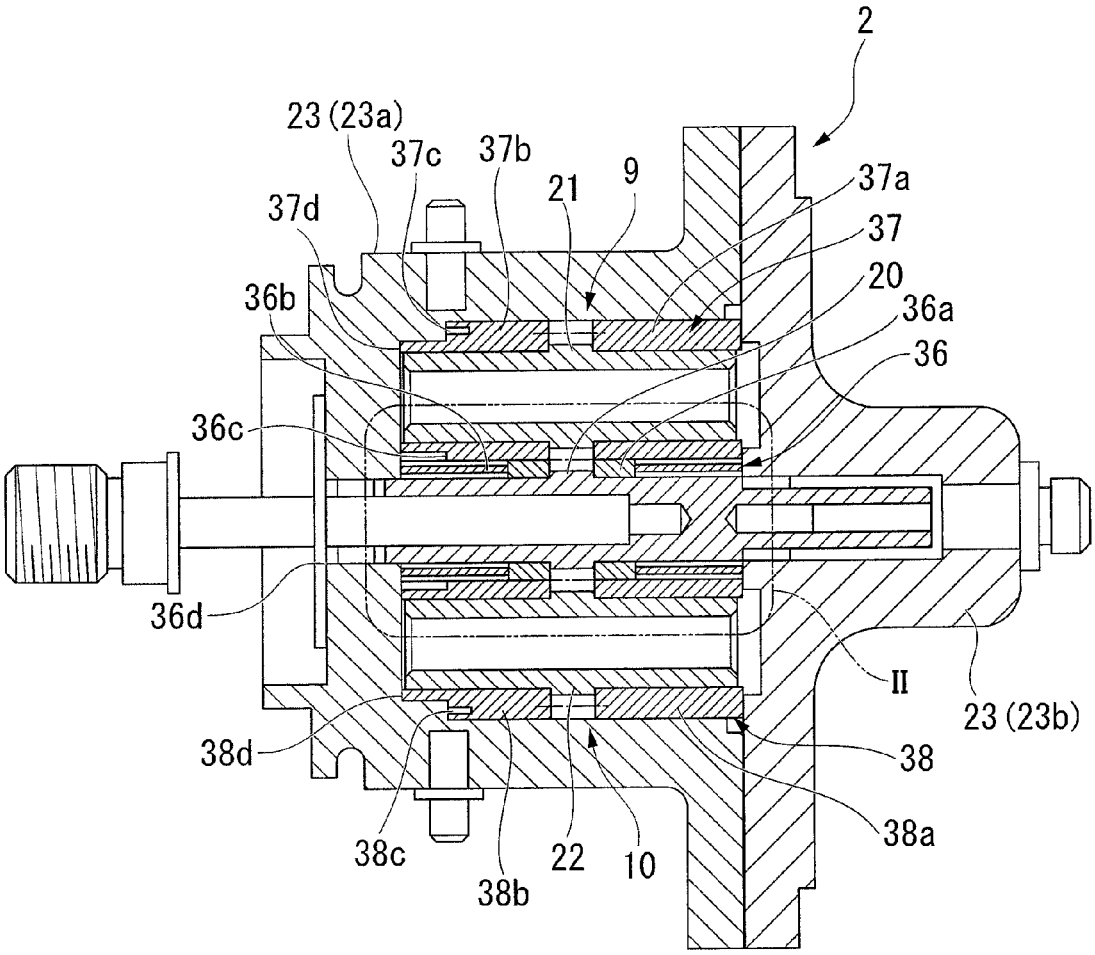
FIG. 3 is a cross-sectional view along I-I in FIG. 2.
Figure 4:
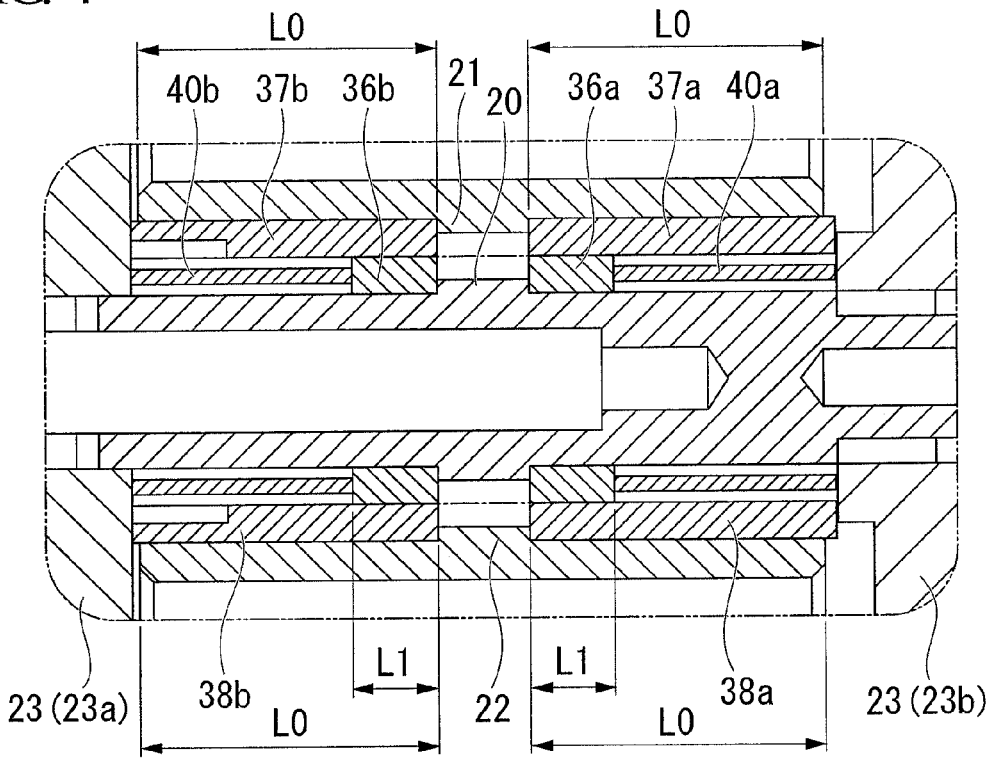
FIG. 4 is a drawing that enlarges a portion of FIG. 3.

FIG. 2 is an outline block diagram of a double-gear-type fuel pump 2 (double gear pump) according to the present embodiment. FIG. 3 is a drawing that shows the cross-section along I-I in FIG. 2. FIG. 4 is a drawing that enlarges a portion of FIG. 3.

The fuel pump 2 is a double gear pump as described above, and is provided with a drive gear 20 that obtains drive force by the rotary movement that is transmitted from a drive system such as the jet engine 4 (refer to FIG. 1) and two driven gears (first driven gear 21 and second driven gear 22) that are oppositely arranged with the drive gear 20 therebetween.

As shown in FIG. 2, the drive gear 20, the first driven gear 21, and the second driven gear 22 have the same gear diameter and the same number of teeth. An involute tooth profile can be favorably used as the tooth profile of the drive gear 20 and the driven gears 21 and 22, but a sine curve tooth profile and a trochoid curve tooth profile are also acceptable.

The driven gears 21 and 22 are made to mesh with the drive gear 20 in respective casings 23 (23*a*, 23*b*). Then, fuel that flows from a first suction opening 24 and a second suction opening 25 into the space between the drive gear 20 and the driven gears 21 and 22 is boosted by being confined to a closed space that is formed by the driven gears 21 and 22 and the inner wall surface of the casings 23 in accordance with the rotation of the drive gear 20 and the driven gears 21 and 22, and thereafter moves to a respective first discharge opening 26 and a second discharge opening 27 to be discharged. That is, the fuel pump 2 is constituted to have a first booster portion 9 composed mainly of the drive gear 20 and the first driven gear 21, and a second booster portion 10 composed mainly of the drive gear 20 and the second driven gear 22. Accordingly, the discharge amounts of the first booster portion 9 and the second booster portion 10 are the same with respect to the rotational frequency of the drive gear 20.

A first suction line 28 and a second suction line 29 that each extend from the fuel tank 1 (refer to FIG. 1) are connected to the first suction opening 24 and the second suction opening 25, and a first discharge line 30 and a second discharge line 31 that each extend from the fuel metering mechanism 3 (refer to FIG. 1) are connected to the first discharge opening 26 and the second discharge opening 27. Also, a check valve 32 from the second suction line 29 to the first suction line 28 is disposed at a middle region of the second suction line 29.

Note that a surplus line (not illustrated in FIG. 2) through which passes the surplus fuel that has been discharged from the fuel metering mechanism 3 described below is connected to the first suction line 28 and the second suction line 29.

As shown in FIG. 3, the drive gear 20, the first driven gear 21, and the second driven gear 22 are supported in a freely rotatable manner by a first bearing 36, a second bearing 37, and a third bearing 38 that each consist of journal bearings.

Each of the bearings 36, 37, 38 are respectively provided with bearing portions 36*a*, 37*a*, 38*a* that are disposed in close contact with one side surface side of each gear (the drive gear 20, the first driven gear 21, and the second driven gear 22), and bearing portions 36*b*, 37*b*, 38*b* that are disposed in close contact with the other side surface side of each gear.

As shown in FIG. 4, the bearing portions 37*a*, 38*a*, 37*b*, 38*b* that constitute the second bearing 37 and the third bearing 38 are formed with their length in the shaft direction being the same (bearing length L0).

In contrast, the bearing portions 36*a* and 36*b* that constitute the first bearing 36 are formed with their length in the shaft direction being short compared to the bearing portions 37*a*, 38*a*, 37*b*, 38*b* (bearing length L1). That is, compared to the bearing length of the second bearing 37 and the third bearing 38 (the length in the shaft direction of the area that makes sliding contact with the rotating shafts of the first driven gear 21 and the second driven gear 22: L0), the bearing length of the first bearing 36 (the length in the shaft direction of the area that makes sliding contact with the drive shaft of the drive gear 20: L1) is shorter.

For this reason, compared to the case of a conventional example in which the bearing lengths of a drive bearing, a first bearing and a second bearing are the same, the bearing loss of the first bearing 36 is reduced.

Note that even in the case of the length in the shaft direction of the bearing portions 36*a* and 36*b* that constitute the first bearing 36 being formed short, it is necessary to make the bearing portions 36*a* and 36*b* closely contact both side surfaces of the drive gear 20. This is in order to prevent leakages of fuel passing between the drive gear 20 and the driven gears 21 and 22.

For this reason, collars 40*a* and 40*b* are provided on the drive shaft of the drive gear 20 for making the bearing portions 36*a* and 36*b* closely contact both side surfaces of the drive gear 20. The collars 40*a* and 40*b* are cylindrical members that fit on the drive shaft of the drive gear 20 similarly to the bearing portions 36*a* and 36*b*. The lengths in the shaft direction of the collars 40*a* and 40*b* are formed so that when added with the lengths in the shaft direction of the bearing portions 36*a* and 36*b* become the same as the length in the shaft direction of the bearing portions 37*a*, 38*a*, 37*b*, 38*b*.

Thereby, in the same manner as the bearing portions 37*a*, 38*a*, 37*b*, 38*b*, the side surfaces in the shaft direction of the collars 40*a* and 40*b* abut the casings 23 (23*a*, 23*b*), and so the bearing portions 36*a*, 36*b* are positioned in close contact with both side surfaces of the drive gear 20.

Also, the inner diameters of the collars 40*a* and 40*b* are formed larger than the bearing portions 36*a* and 36*b*, while on the other hand the outer diameters thereof are the same or slightly smaller than the bearing portions 36*a* and 36*b*. Accordingly, even when the collars 40*a* and 40*b* are fitted on the drive shaft of the drive gear 20, they hardly exert an adverse effect on the rotation of the drive shaft due to friction and the like.

Incidentally, the first driven gear 21 and the second driven gear 22 that engage with the drive gear 20 are arranged at symmetrical positions with respect to the drive gear 20, and also have the same gear diameter and the same number of teeth.

For this reason, when the drive gear 20 is rotationally driven, reactive forces F1 and F2 (refer to FIG. 2) that the drive gear 20 receives from the first driven gear 21 and the second driven gear 22 are the same strength. Also, the directions thereof are point symmetric with respect to the drive shaft of the drive gear 20.

Also, fluid pressures R1 and R2 (refer to FIG. 2) around the first driven gear 21 and the second driven gear 22 that mesh with the drive gear 20 are also point symmetric with respect to the drive shaft, similarly to the reactive forces F1 and F2.

Accordingly, the reactive forces F1 and F2 cancel out, and the loads R1 and R2 that arise from hydraulic pressure also cancel out. Thereby, the load that acts on the first bearing 36 that supports the drive shaft of the drive gear 20 becomes smaller compared to the second bearing 37 and the third bearing 38. For that reason, it is possible to make the bearing length of the first bearing 36 (the bearing portions 36*a* and 36*b*) shorter compared to the second bearing 37 and the third bearing 38 (the bearing portions 37*a*, 38*a*, 37*b*, and 38*b*).

Next, the operation of the fuel supply system S that is provided with the fuel pump 2 of the present embodiment shall be described.

First, fuel that is stored in the fuel tank 1 is supplied to the fuel pump 2. At this time, the fuel is supplied to the first suction opening 24 and the second suction opening 25 of the fuel pump 2 via the first suction line 28 and the second suction line 29. The fuel that is supplied to the first suction opening 24 is boosted by rotation of the first driven gear 21 that rotates along with the rotation of the drive gear 20 and by being confined to a closed space that is formed by the first driven gear 21 and the inner wall surface of the casing 23, and afterward discharged from the fuel pump 2 via the first discharge opening 26.

Also, the fuel that is supplied to the second suction opening 25 is boosted by rotation of the second driven gear 22 that rotates along with the rotation of the drive gear 20 and by being confined to a closed space that is formed by the second driven gear 22 and the inner wall surface of the casing 23, and afterward discharged from the fuel pump 2 via the second discharge opening 27.

Accordingly, the fuel of the first and second discharge openings 26 and 27 is put in a higher pressure state than the fuel of the first and second suction openings 24 and 25. For this reason, in the case of there being a gap between the drive gear 20 and the first driven gear 21, or between the drive gear 20 and the second driven gear 22, the fuel of the first discharge opening 26 leaks to the first suction opening 24, and the fuel of the second discharge opening 27 leaks to the second suction opening 25.

At this time, since the bearing loss of the first bearing 36 is reduced in the fuel pump 2, it is possible to realize a more efficient fuel supply than before.

Then, the fuel that is high pressurized by the fuel pump 2 is discharged to the fuel metering mechanism 3 via the first discharge line 30 and the second discharge line 31. Then in the fuel metering mechanism 3 a portion of the fuel is discharged as a predetermined amount toward the jet engine 4, with the remainder being returned to the fuel pump 2 as a surplus portion after being depressurized.

Next, the fuel that has been discharged from the fuel supply system S (fuel metering mechanism 3) to the jet engine 4 is subjected to heat exchange in the fuel cooling oil cooler 7 with oil that is used in the jet engine 4, and then supplied to the combustor 5 of the jet engine 4.

Then, the fuel is combusted in the engine combustor 5, and the fan 6 is driven by the energy of this combustion, leading to rotative power.

Above, the preferred embodiment of the fuel pump 2 (double gear pump) according to the present invention was described while referring to the appended drawings, but the present invention is needless to say not limited to the above embodiment. The shape and combination of each component member shown in the embodiment described above is one example, and various modifications can be made within the scope of not departing from the purport of the present invention.

For example, in the aforementioned embodiment, the description was given taking the fuel supply system S that has the fuel pump 2 as one constitution as an example. However, the gear pump according to the present invention is not limited to a gear pump that is provided in this type of fuel supply system S, and is capable of being applied to all double gear pumps that boost and discharge a fluid or the like.

In the aforementioned embodiment, the case was described of shortening the respective bearing lengths of the bearing portions 36*a* and 36*b* that constitute the first bearing 36, but is not limited thereto. It is also acceptable to shorten only the bearing length of either one of the bearing portions 36*a* and 36*b*.

Also, the description was given of the case of using the cylindrical collars 40*a* and 40*b* in order to bring the bearing portions 36*a* and 36*b* into close contact with both side surfaces of the drive gear 20, but is not limited thereto. Provided it is possible to bring the bearing portions 36*a* and 36*b* into close contact with both side surfaces of the drive gear 20, they may be members of any shape.

Figure 5:
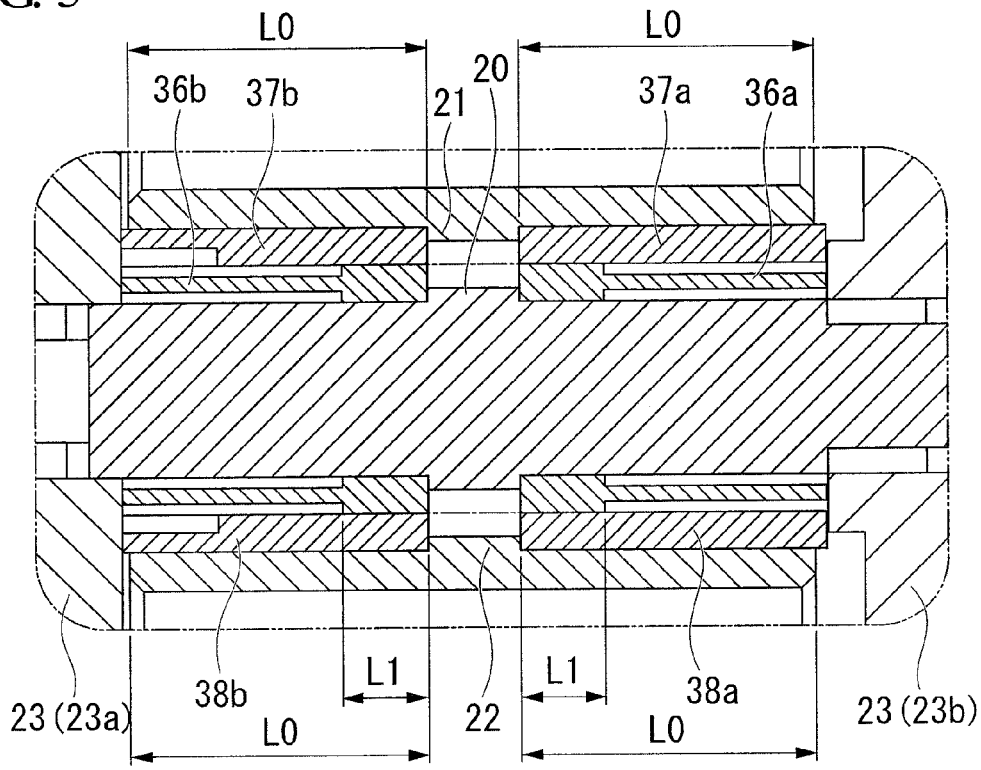
FIG. 5 is a drawing that shows a modification of bearing portions 36*a* and 36*b*.

FIG. 5 is a drawing that shows a modification of the bearing portions 36*a* and 36*b*.

In the aforementioned embodiment, the description was given of the case of using the collars 40*a* and 40*b* separately from the bearing portions 36*a* and 36*b*, but is not limited thereto. For example, as shown in FIG. 5, it may be a case in which members that are the same as the collars 40*a* and 40*b* may be integrally formed with the bearing portions 36*a* and 36*b*.

Even in this case, compared to the bearing lengths of the second bearing 37 and the third bearing 38 (length in the shaft direction of the area that makes sliding contact with the rotating shafts of the first driven gear 21 and the second driven gear 22: L0), the bearing length of the first bearing 36 (the length in the shaft direction of the area that makes sliding contact with the drive shaft of the drive gear 20: L1) is shorter. For this reason, the same effect is obtained as the case of using the collars 40*a* and 40*b* that are separate from the bearing portions 36*a* and 36*b*.

Figure 6:
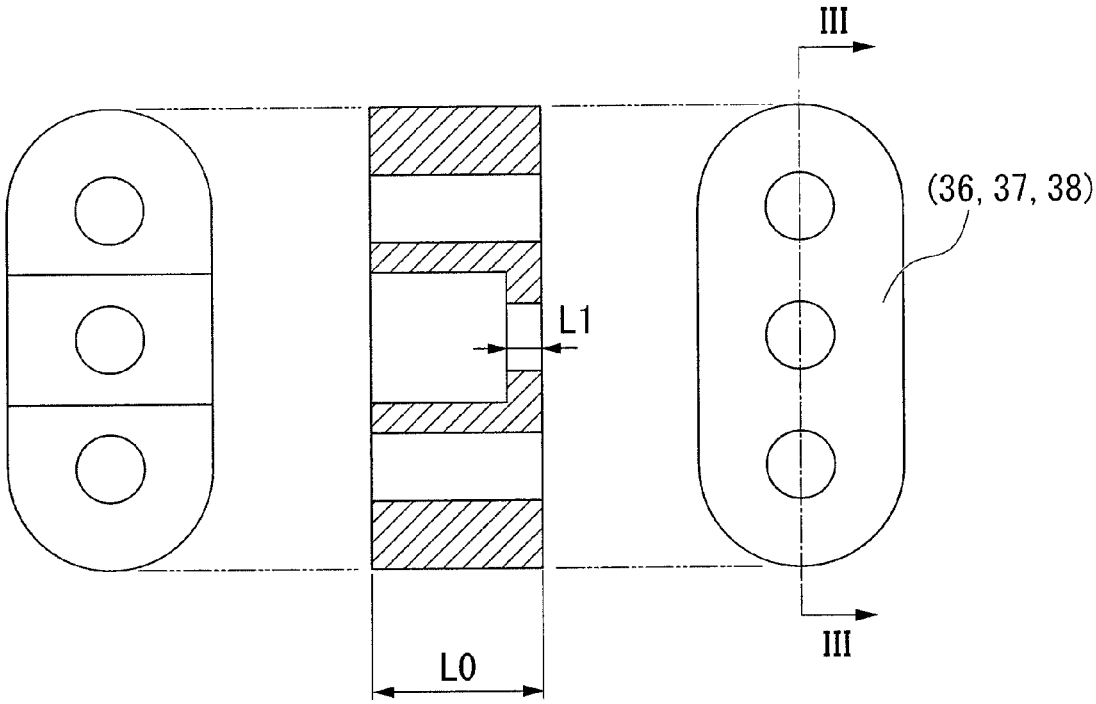
FIG. 6 is a drawing that shows a modification of bearings 36, 37, and 38.

FIG. 6 is a drawing that shows a modification of the bearings 36, 37 and 38.

In the abovementioned embodiment, the description was given of the case of the first bearing 36, the second bearing 37, and the third bearing 38 being separately formed, but is not limited thereto. For example, as shown in FIG. 6, the first bearing 36, the second bearing 37, and the third bearing 38 may be integrally formed. Specifically, the bearing portions 36*a*, 37*a*, 38*a* and the bearing portions 36*b*, 37*b*, 38*b* may be respectively integrated so as to constitute journal bearings.

Even in this case, compared to the bearing lengths of the areas corresponding to the second bearing 37 and the third bearing 38 (length in the shaft direction of the area that makes sliding contact with the rotating shafts of the first driven gear 21 and the second driven gear 22: L0), the bearing length of the area corresponding to the first bearing 36 (the length in the shaft direction of the area that makes sliding contact with the drive shaft of the drive gear 20: L1) is shorter. For this reason, the same effect is obtained as the cases of FIG. 4 and FIG. 5.

[Industrial Applicability]

By the present invention, it is possible to provide a double gear pump that is capable of easily and reliably reducing the bearing loss of a bearing that supports a gear.

What is claimed is:

1. A double gear pump comprising:

a drive gear;

two driven gears that are oppositely arranged with the drive gear therebetween;

a first bearing that supports a drive shaft of the drive gear; and second and third bearings that support rotating shafts of the two driven gears, wherein the first bearing length is formed shorter than the second and third bearing lengths, the first bearing includes a pair of first bearing portions that are oppositely arranged with the drive gear therebetween, the pair of first bearing portions of the first bearing having the same length in the shaft direction, the second bearing includes a pair of second bearing portions that are oppositely arranged with a first driven gear therebetween, the third bearing includes a pair of third bearing portions that are oppositely arranged with a second driven gear therebetween, the pair of second bearing portions of the second bearing and the pair of third bearing portions of the third bearing having the same length in the shaft direction, and the length of the pair of first bearing portions of the first bearing in the shaft direction is shorter than the length of the pair of second bearing portions of the second bearing and the pair of third bearing portions of the third bearing in the shaft direction.

2. The double gear pump according to claim 1, wherein the first bearing is disposed in close contact with the side surface of the drive gear.

3. The double gear pump according to claim 1, further comprising a positioning member that brings the first bearing into close contact with the side surface of the drive gear.

4. The double gear pump according to claim 3, wherein the first bearing is integrally formed with the positioning member.

* * * * *

UNITED STATES PATENT AND TRADEMARK OFFICE

CERTIFICATE OF CORRECTION

PATENT NO. : 8,672,657 B2
APPLICATION NO. : 12/438445
DATED : March 18, 2014
INVENTOR(S) : Masuda et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1114 days.

Signed and Sealed this
Twenty-ninth Day of September, 2015

Michelle K. Lee

Michelle K. Lee
*Director of the United States Patent and Trademark Office*